US006495781B2

(12) United States Patent
Greenberg et al.

(10) Patent No.: US 6,495,781 B2
(45) Date of Patent: Dec. 17, 2002

(54) HANDLE POSITION INDICATOR

(75) Inventors: Randall Lee Greenberg, Granby, CT (US); Roger Neil Castonguay, Terryville, CT (US); Thomas Frederick Papallo, Jr., Farmington, CT (US)

(73) Assignee: General Electric Company, Schenectady, NY (US)

( * ) Notice: Subject to any disclaimer, the term of this patent is extended or adjusted under 35 U.S.C. 154(b) by 43 days.

(21) Appl. No.: 09/748,882

(22) Filed: Dec. 27, 2000

(65) Prior Publication Data

US 2002/0079207 A1 Jun. 27, 2002

(51) Int. Cl.[7] ..... H01H 9/00

(52) U.S. Cl. ..... 200/308; 200/308; 200/330; 200/331; 200/333; 200/334

(58) Field of Search ..... 200/308, 331, 200/330, 333, 334, 50.26, 50.01, 50.11

(56) References Cited

U.S. PATENT DOCUMENTS 4,042,896 A * 8/1977 Powell et al. ..... 335/17
4,167,988 A 9/1979 Acampora et al. ..... 185/40 K
4,245,140 A 1/1981 Jencks et al. ..... 200/153
5,323,131 A * 6/1994 Castonguay ..... 335/68
5,477,016 A 12/1995 Baginski et al. ..... 200/43.11
5,545,867 A 8/1996 Castonguay et al. ..... 200/400
5,791,457 A 8/1998 Castonguay et al. ..... 200/400
5,981,887 A * 11/1999 Robarge et al. ..... 200/308

* cited by examiner

*Primary Examiner*—Elvin Enad
*Assistant Examiner*—Jennifer A. Poker

(57) ABSTRACT

An indicator on a stored energy motor operator indicates that the circuit breaker is "on" when the contacts are closed and the handle is in an on position and when the contacts are open and the handle is in an on position. The indicator only indicates that the circuit breaker is "off" when the contacts are open and the handle is in an off position. To achieve these conditions, the stored energy motor operator includes a flag bearing on and off indicia, the flag attached to one end of a connecting bar, the other end of the connecting bar pivotally connected within the stored energy motor operator. A lever is attached to a central portion of the connecting bar at a spring, the lever including a hook portion for hooking onto a pin within the motor operator. When the contacts are closed, thus indicating an "on" condition, the lever remains hooked onto the pin. When the contacts are open, on-off indicator attached to a rotor drive pin within the circuit breaker moves the lever off of the pin. The connecting bar, however, does not move away from the pin until the handle is also in the off position and moves a second pin extending from the handle so that the connecting bar can move in its spring biased direction.

26 Claims, 8 Drawing Sheets

HANDLE POSITION INDICATOR

BACKGROUND OF THE INVENTION

The present invention relates generally to a circuit breaker with a stored energy motor operator, and more particularly this invention relates to a stored energy motor operator which does not indicate an off condition when the handle is in an on/closed position.

Stored Energy motor operators provide closing times of breakers in under 300 micro-seconds (ms). These can be used in uninterrupted power supplies where one breaker is interlocked to the other so that both cannot be closed. Inherent in the design is the possibility that the motor operator can be closed on the auxiliary breaker but because the contacts are blocked due to the interlock, the motor operator does not indicate that the motor operator is discharged, which would cause inadvertent closing of the auxiliary breaker when the main breaker is opened.

U.S. Pat. No. 5,477,016 to Baginski et al, for example, discloses an add-on remote control unit for a circuit breaker in which an indicator is arranged at the top end of an operating lever, operatively connected with the circuit breaker for indicating whether the contacts are in the open or closed state. This device does not, however, prevent the inadvertent closing of an auxiliary breaker when a main breaker is opened because the indication relies solely on whether the contacts are separated or not.

BRIEF SUMMARY OF THE INVENTION

The above discussed and other drawbacks and deficiencies are overcome or alleviated by a circuit breaker assembly comprising a rotary circuit breaker including a top cover, a midcover, a base, a moveable rotor drive pin, an on-off indicator having a first end and a second end, the rotor drive pin connected to the second end of the on-off indicator, and a handle. The circuit breaker assembly further preferably comprises a stored energy motor operator mounted to the top cover of the rotary circuit breaker, the stored energy motor operator including a flag, a connecting bar attached to the flag, a lever having a first end and a second end, the first end of the lever attached to the connecting bar, a hook portion of the lever between the first end and the second end, and, a pin seatable within the hook portion of the lever, the pin preventing the lever from movement towards the connecting bar when seated within the hook portion.

The above-discussed and other features and advantages of the present invention will be appreciated and understood by those skilled in the art from the following detailed description and drawings.

BRIEF DESCRIPTION OF THE DRAWINGS

Referring to the FIGURES wherein like elements are numbered alike in the several FIGURES.

DETAILED DESCRIPTION OF THE INVENTION

Figure 1:
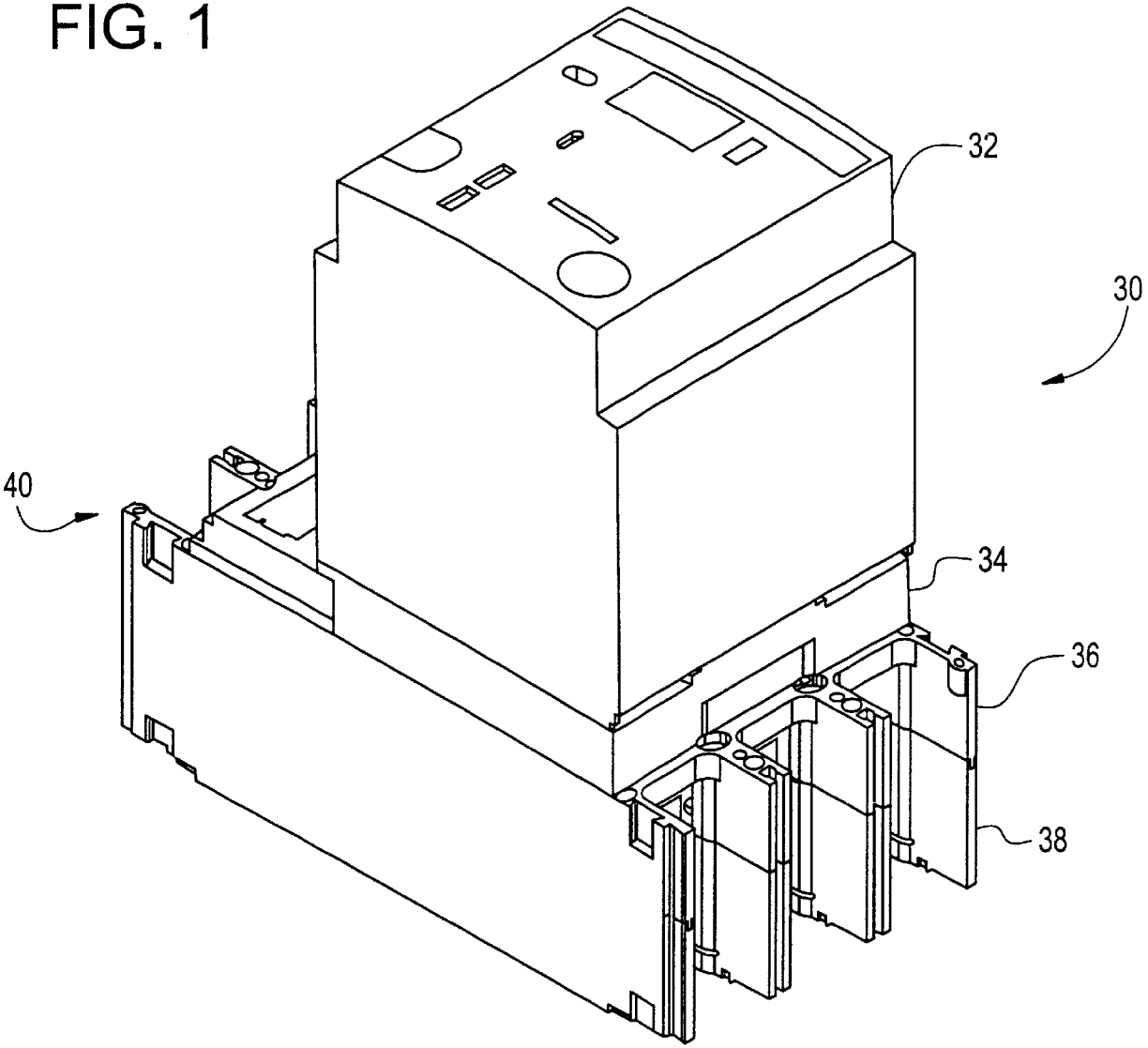
FIG. 1 shows a perspective view of a circuit breaker assembly including a circuit breaker and a stored energy motor operator.

As shown in FIG. 1, circuit breaker assembly 30 includes remote device or stored energy motor operator 32 which attaches to a multipole circuit breaker 40. The circuit breaker 40 includes a top cover 34, a midcover 36, and a base 38. Although a three pole circuit breaker is shown, more or less poles in a circuit breaker would be within the scope of this invention.

Figure 2:
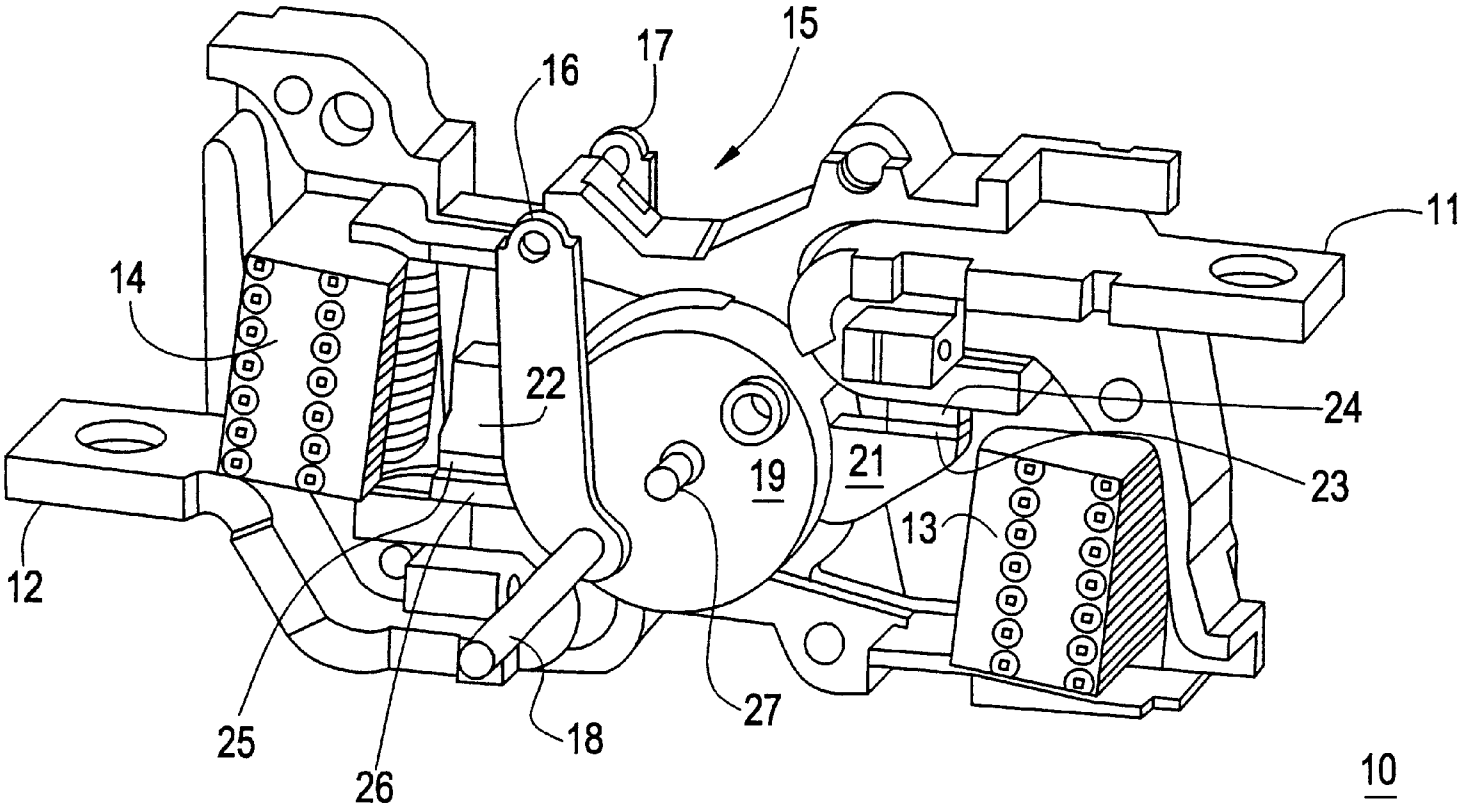
FIG. 2 shows a rotary contact assembly usable in the circuit breaker of FIG. 1.

Within the circuit breaker 40, a circuit breaker rotary contact assembly 10 as shown in FIG. 2. Within a three pole circuit breaker, two similar rotary contact assemblies 10 would also be provided within the base 28 and midcover 36. Opposing line and load straps 11, 12 are adapted for connection with an associated electrical distribution system and a protected electric circuit, respectively. Fixed contacts 24, 26 connect with the line and the load straps while the moveable contacts 23, 25 are attached to the ends of moveable contact arms 21, 22 for making moveable connection with the associated fixed contacts to complete the circuit connection with the line and load straps 11, 12. The rotor 19 may rotate about a rotor pivot 27 in response to the circuit breaker operating mechanism and interacts with the moveable contact arms 21, 22. The moveable contact arms 21, 22 are preferably of unitary structure and rotate within the rotor and contact arm assembly 15 about the pivot 27 when rotated upon response to the circuit breaker operating mechanism by connection via the rotor drive pin 18 and the pair of opposing levers 16, 17. The arcs generated when the contacts 23, 24 and 25, 26 are separated upon overload circuit current conditions are cooled and quenched within the arc chambers 13, 14 to interrupt current through the protected circuit.

Figure 3:
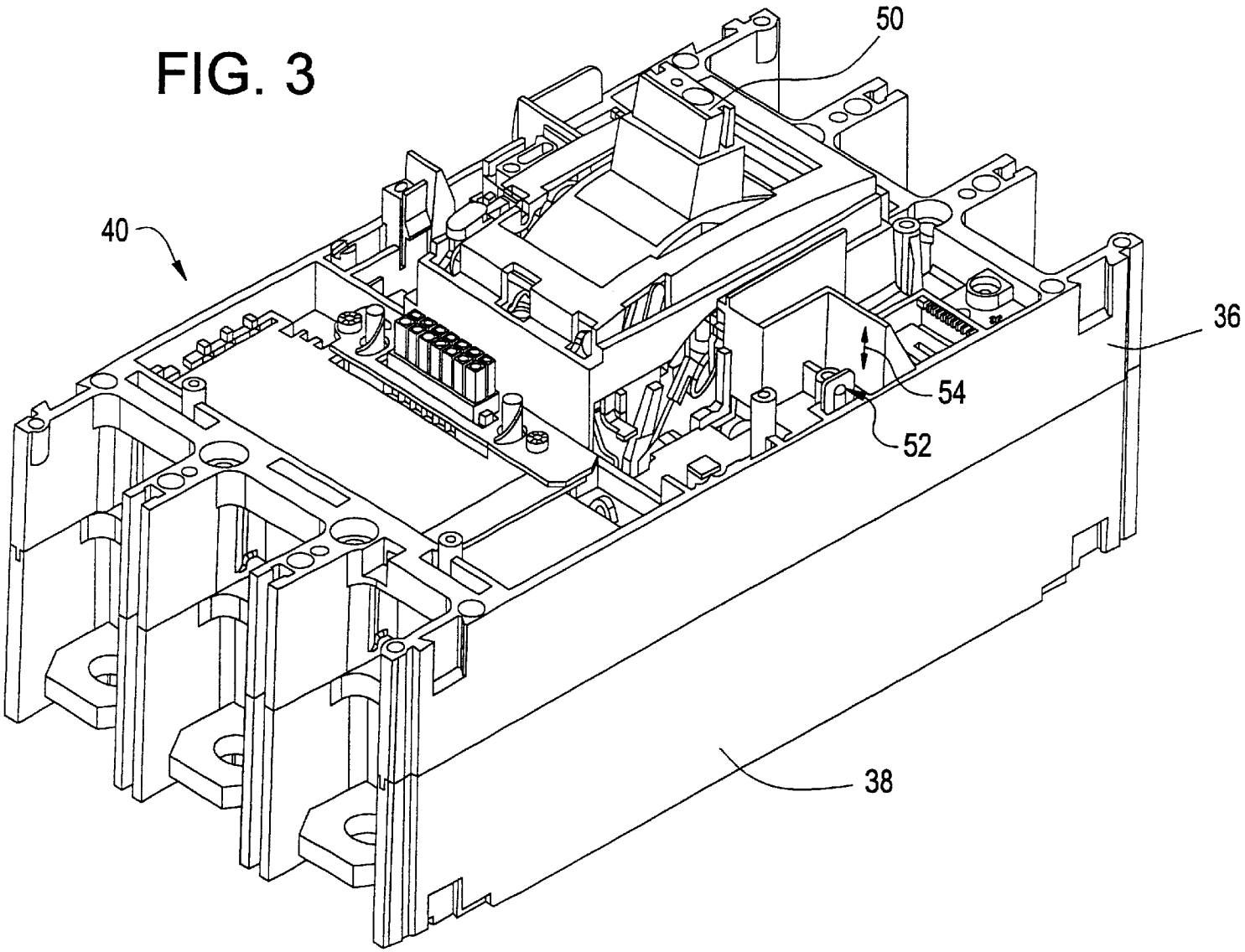
FIG. 3 shows a perspective view of the circuit breaker of FIG. 1 with the top cover removed.

FIG. 3 shows the circuit breaker 40 with stored energy motor operator 32 and top cover 34 removed to reveal the handle 50 as well as a top portion of on-off indicator 52 which moves either up or down in the direction of double-sided arrow 54 in response to whether or not the contacts 23, 24 and 25, 26 are separated.

Figure 4:
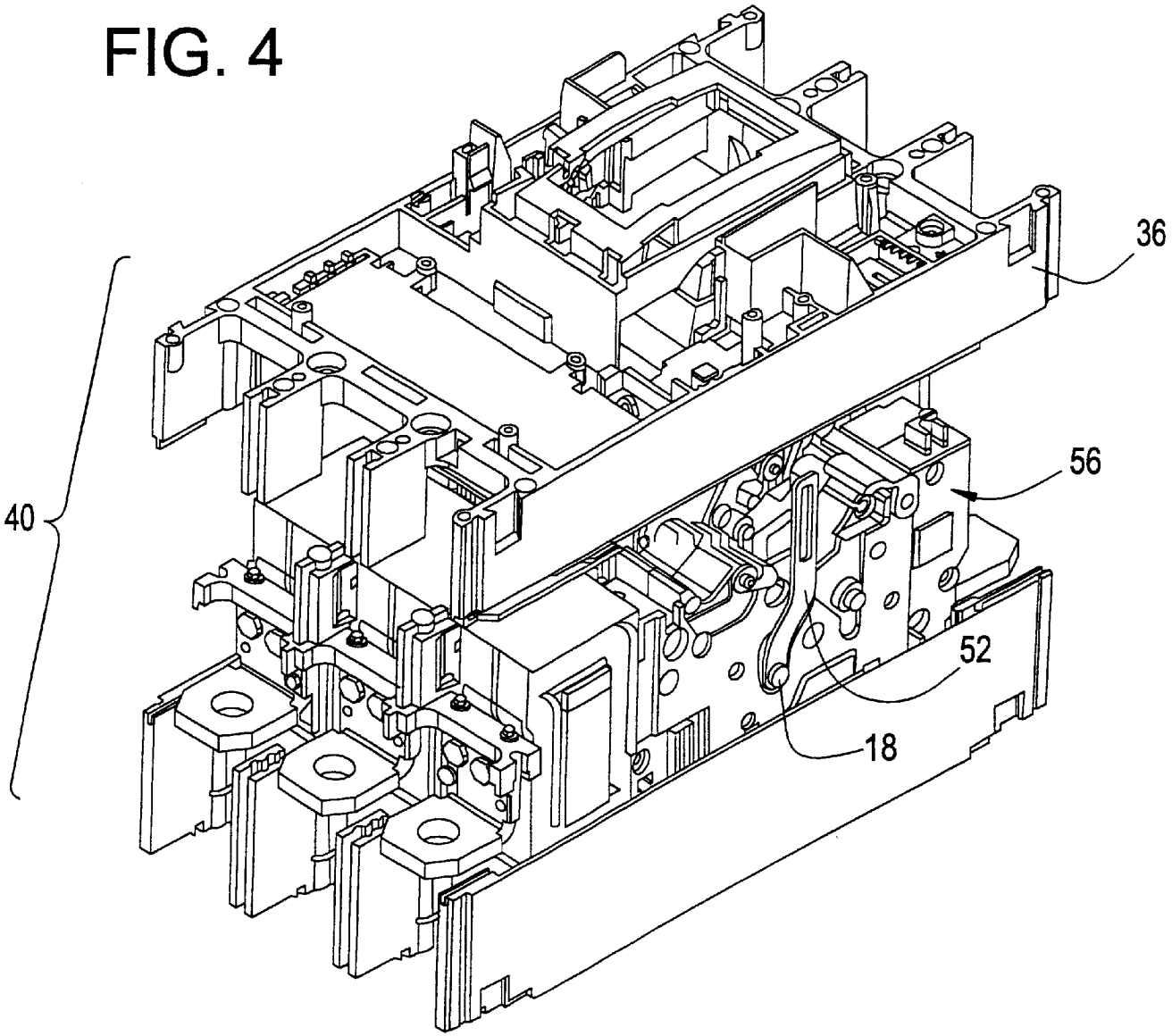
FIG. 4 shows an exploded perspective view of the circuit breaker of FIG. 1 with the top cover removed and the mid cover partially removed.

FIG. 4 also shows the circuit breaker 40 except with the midcover 36 partially removed to reveal a cassette 56 which houses a circuit breaker rotary contact assembly 10 as shown in FIG. 2. As the circuit breaker 40 as shown is a three pole circuit breaker, the circuit breaker 40 would include three cassettes 56. Also shown in FIG. 4 is a full view of the on-off indicator 52 which is operatively connected with the interior of the cassette 56 via the rotor drive pin 18.

Figure 5:
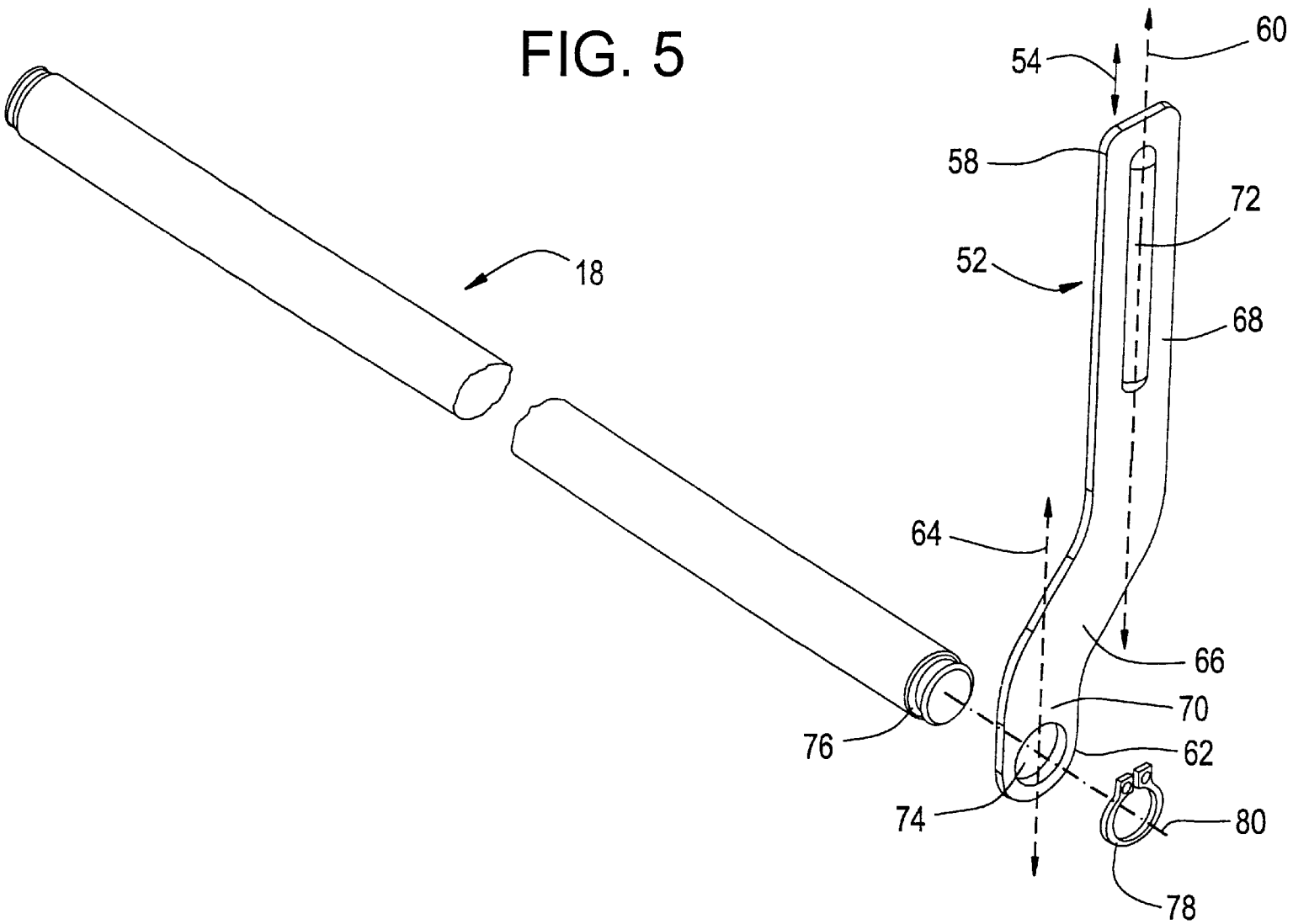
FIG. 5 shows an exploded perspective view of a rotor drive pin and an on-off indicator for use in the circuit breaker of FIG. 1.

As shown in FIG. 5, the on-off indicator 52 includes a first end 58 lying along a first longitudinal axis 60 and a second end 62 lying along a second longitudinal axis 64 of the on-off indicator 52, the first and second longitudinal axes 60, 64 being parallel. An angled section 66 connects a first straight section 68 to a second straight section 70 of the on-off indicator 52. The first straight section 68 includes a slot 72 and the second straight section 68 includes an aperture 74. The aperture 74 is sized to receive an end 76 of the rotor drive pin 18. A clamp 78 may be used to secure the end 76 to the on-off indicator 52, although other securing devices are within the scope of this invention. Preferably, the longitudinal axis 80 of the rotor drive pin 18 is perpendicular to the first longitudinal axis 64. The on-off indicator 52 is thus directly connected to the rotor drive pin 18 to indicate if the rotor is open or closed by movement of this indicator 52 in the vertical direction as demonstrated by arrow 54.

Figure 6:
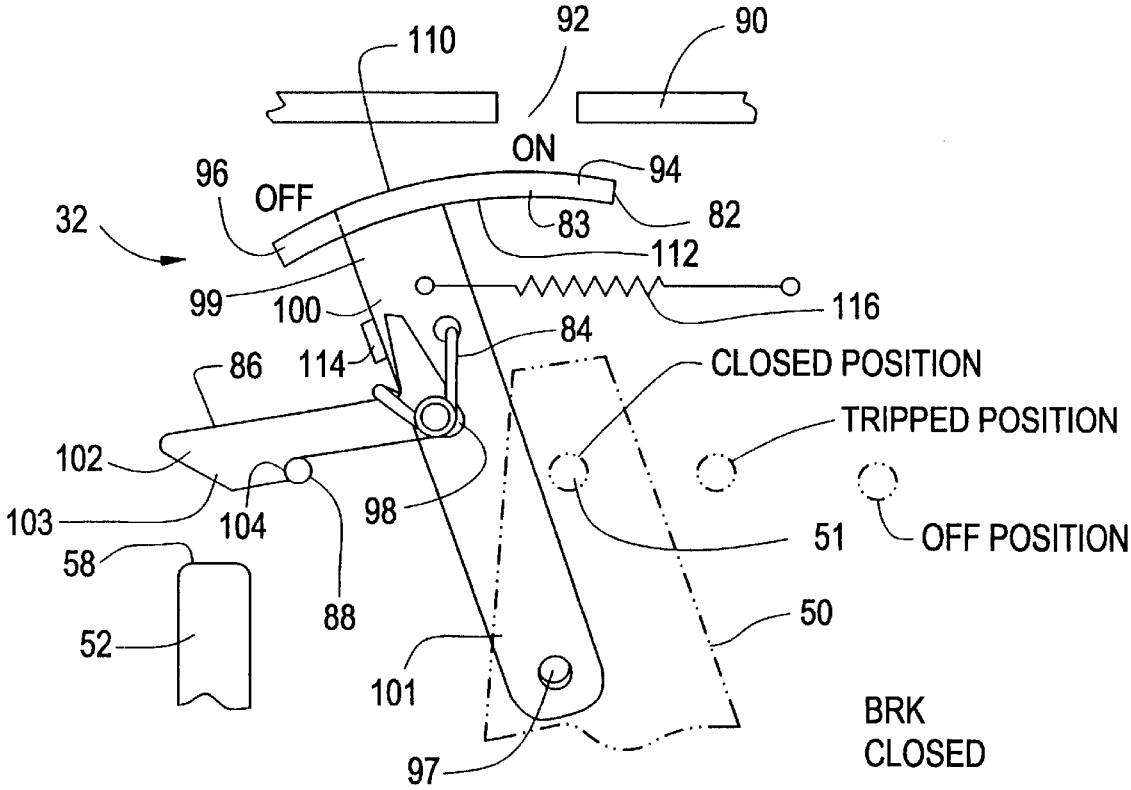
FIG. 6 shows a diagrammatic interior view of the stored energy motor operator of FIG. 1 undergoing a condition wherein separable contacts of the circuit breaker are abutting and the handle is in an on position.
Figure 7:
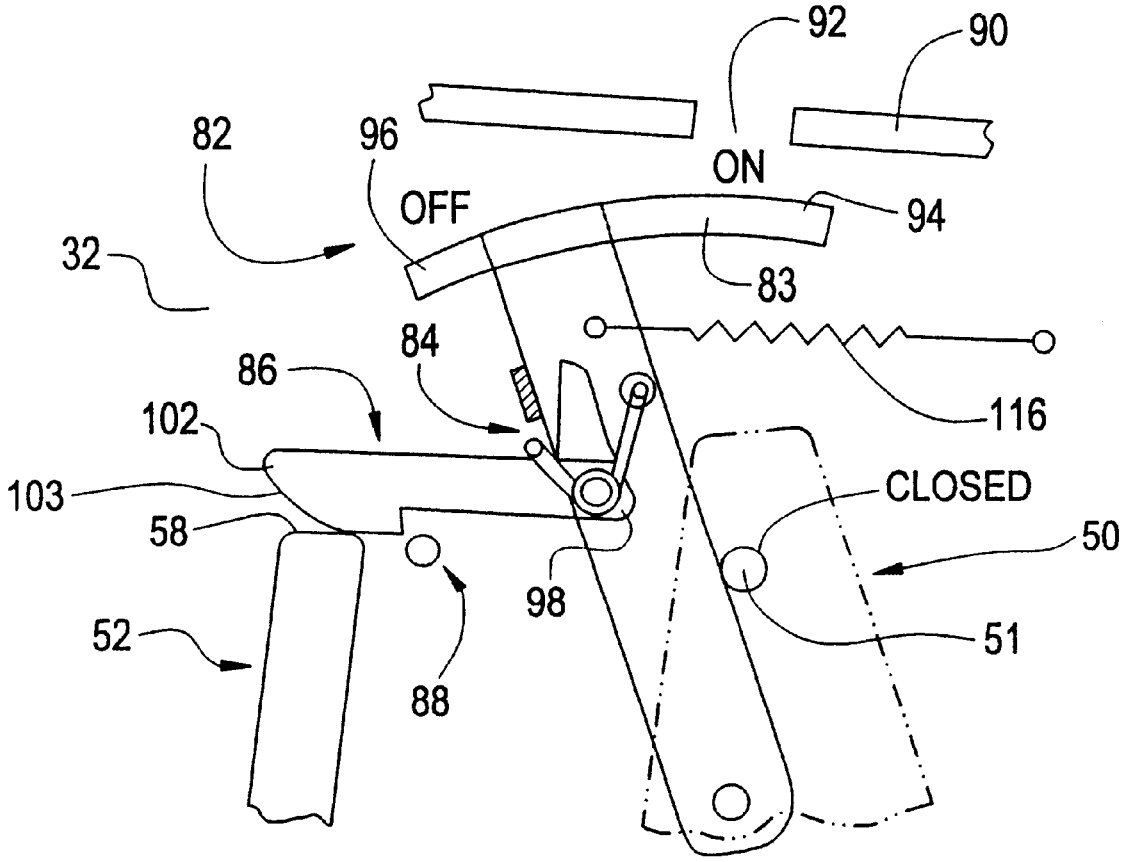
FIG. 7 shows a diagrammatic interior view of the stored energy motor operator of FIG. 1 undergoing a condition wherein separable contacts of the circuit breaker are separated but the handle is still in an on position; and, FIG. 8 shows a diagrammatic interior view of the stored energy motor operator of FIG. 1 undergoing a condition wherein separable contacts of the circuit breaker are separated and the handle is in an off position.
Figure 8:
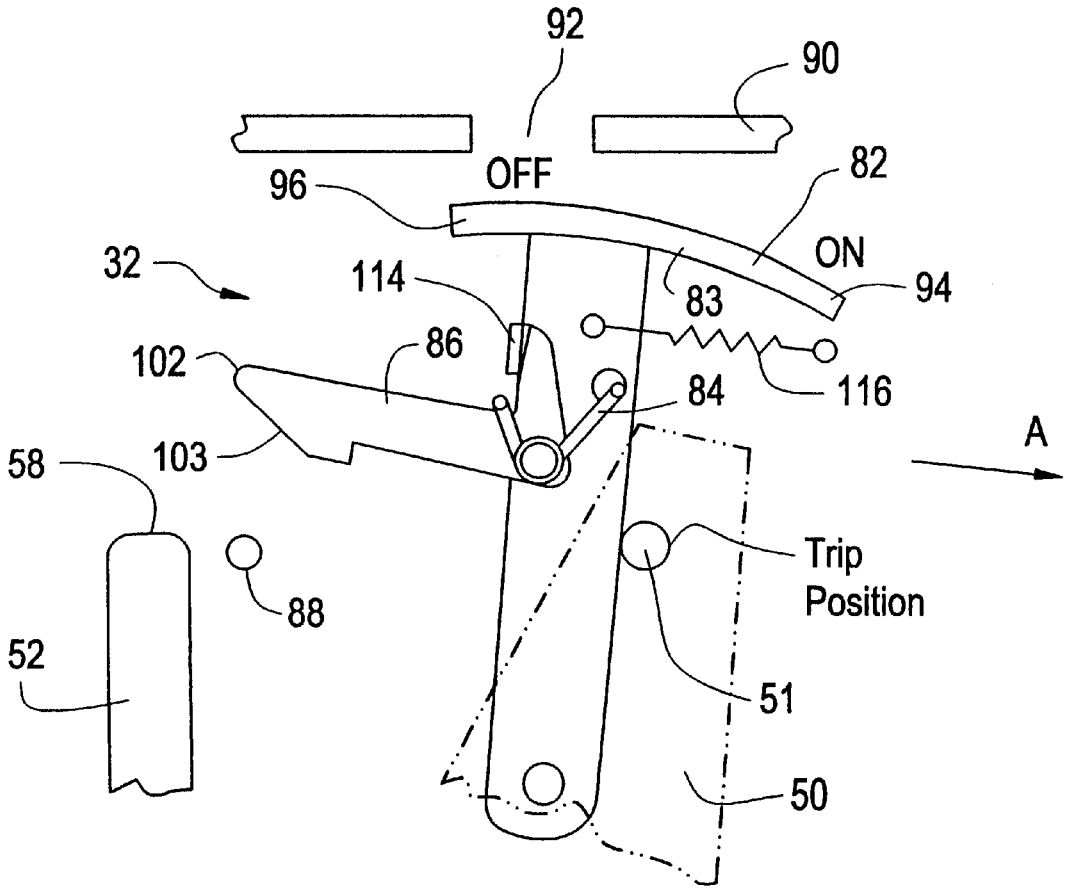

FIGS. 6–8 show the first end 58 of the on-off indicator 52 within the motor operator 32. Components within the motor operator 32 include an on-off flag 82, a spring 84 such as a torsion spring, and a lever 86 which interfaces with the on-off indicator 52 and a pin 88. A top surface 90 of the motor operator 32 includes a window 92 for viewing the on-off flag 82. The on-off flag 82 preferably includes a curved member 83 having a first end 94 and a second end 96. The first end 94 is preferably imprinted with the word "on" or other suitable indicia indicating an on condition and the second end 96 is preferably imprinted with the word "off"or other suitable indicia indicating an off condition. The indicia is preferably imprinted on an outer surface 110 which faces the top surface 90, while an inner surface 112 of the curved member 83 is attached to a first end 99 of the connecting bar 100. Also enclosed within the motor operator 32 is the handle 50 of the circuit breaker 40 which is shown in phantom. A second end 101 of the connecting bar 100 includes a pivot pin 97 which allows for pivotal movement of the connecting bar 100 within the stored energy motor operator 32. A pin 51, shown in FIGS. 6–8 may extend from the handle 50 to interfere with movement of the connecting bar 100 as will be described below.

The condition shown in FIG. 6 is when the contacts move to the on position, i.e., the contacts 24, 26 are in an abutting and closed position. The flag 82 positions the first end 94 of the curved member 83 within the window 92 to indicate an "on" condition. The lever 86 includes a first end 98 attached to connecting bar 100 at spring 84, and a second end 102 having a cam surface 103 facing the on-off indicator 52. The spring 84 biases the second end 102 of the lever 86 downwards towards the on-off indicator 52 (as shown, the spring 84 biases the second end 102 in a counterclockwise direction). Between the first end 98 and the second end 102 is a hook portion 104 of the lever 86 which latches onto pin 88 in the condition shown in FIG. 6. The spring 84 retains the hook portion 104 on the pin 88. As shown, the handle 50 is in a position which indicates that the breaker 40 is "closed", meaning that the contact pairs 23, 24 and 25, 26 are closed and in an abutting condition, which, in turn, means that the breaker is "on".

The condition shown in FIG. 7 is where the handle 50 is moved to the on position (as in FIG. 6) but the rotors are blocked from an interlock and thus the contacts 23, 24 and 25, 26 are in an off position, i.e. the contact pairs are separated. The rotor drive pin 18 is in a position corresponding to the off state of the contacts which moves the on-off indicator 52 in a vertically upwards direction, in a direction towards the top surface 90 of the motor operator 32. The first end 58 of the on-off indicator 52 interfaces with the cam surface 103 of the second end 102 of the lever 86 to release the pin 88. However, because the handle 50 is still in the on position, the motor operator 32 still indicates the handle 50 in the on position even though the contacts 23, 24 and 25, 26 are in the off position. This is due to the pin 51 which extends from the handle 50 and prevents the connecting bar 100 from moving, which in turn retains the flag 82 in the "ON" position as shown.

The only way the flag 82 can indicate "off" is when both the handle 50 is in the off position and the contacts 23, 24 and 25, 26 are in the off position as shown in FIG. 8. The indicator 52 moves the hook portion 104 of the lever 86 off the pin 88 as previously shown in and described with respect to FIG. 7. The lever 86 is prevented from further rotation about the spring 84 by a stopping member 114 attached to the connecting bar 100. Once the lever 86 is released from the pin 88, and the connecting bar 100 is not blocked from movement by the pin 51 extending from the handle 50, an additional spring 116, such as an extension spring, which is connected at one end to the connecting bar 100 and at another end within the motor operator 32, draws the connecting bar 100, and thus the lever 86, towards direction A. The spring 116 biases the connecting bar 100 in the A direction, however the connecting bar 100 is prevented from moving in the A direction until both the pin 88 is released from the lever 86 and the handle 50 is moved to an off position moving the pin 51 out of the way of the connecting bar 100. Thus, the flag 82 is allowed to move correspondingly with the connecting bar 100 to the off position where the second end 96 of the curved member 83 is visible through the window 92 of the top surface 90 of the motor operator 32.

The handle cannot be in the off position while the contacts are in an on position. In that respect, it would be seemingly possible, however not preferable, to link the flag 82 directly to the handle 50. Because of arcing, the separable contacts cannot be slowly or gradually separated or closed, they will separate virtually immediately based on tripping action and will likewise close (abut) virtually immediately when signaled to close. The handle 50, on the other hand, could potentially be moved slowly, and could even become located within a "dead zone" somewhere between on and off. Therefore, linking only the handle 50 to the flag 82 may have undesirable consequences, such as displaying neither an on or off condition if the handle has been moved too slowly, which would not give an indication of the state of the contacts. Thus, it is the preferred embodiment to link the flag 82 to the on-off indicator 52, which provides a clear indication of whether the contacts are open or closed, as well as the handle 50, as has been described.

The present invention thus describes a method where the motor operator 32 only indicates off when the breaker handle is in the off position and the contacts are open when used in a rotary breaker.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A stored energy motor operator for a mounting exteriorly on a circuit breaker, the stored energy motor operator comprising:

a flag having a first end and a second end, the first end bearing indicia relating to an ON condition, the second end bearing indicia relating to an OFF condition;

a connecting bar attached to the flag, the connecting bar moveable within the motor operator;

a lever having a first end and a second end, the first end of the lever attached to the connecting bar, a hook portion of the lever between the first end and the second end; and, a first pin seatable within the hook portion of the lever, the pin preventing the connecting bar from movement in a direction away from the pin when the pin is seated within the hook portion of the lever.

2. The stored energy motor operator of claim 1 wherein the connecting bar includes a first end and a second end, the first end of the connecting bar attached to the flag, and the second end attached to a pivot pin for pivotal movement of the connecting bar within the stored energy motor operator.

3. The stored energy motor operator of claim 2 wherein the first end of the lever is attached to the connecting bar between the first and second ends of the connecting bar, a spring positioned at the first end of the lever.

4. The stored energy motor operator of claim 1 wherein the second end of the lever includes a cam surface.

5. The stored energy motor operator of claim 1 wherein the indicia on the first end of the flag is "ON" and the indicia on the second end of the flag is "OFF".

6. The stored energy motor operator of claim 1 further comprising a top surface having a window, wherein the flag is moveable relative to the window to position either the first end or second end of the flag within the window.

7. The stored energy motor operator of claim 3 wherein the lever is spring biased towards the first pin.

8. The stored energy motor operator of claim 1 further comprising a spring attached at one end to the connecting bar and at another end within the stored energy motor operator, wherein the connecting bar is spring biased in a opposite direction of the first pin.

9. The stored energy motor operator of claim 1 wherein the flag comprises a curved member, an inner surface of the curved member attached to the connecting bar and an outer surface of the curved member carrying the indicia on the first end and the indicia on the second end of the flag.

10. A circuit breaker assembly comprising:

a rotary circuit breaker including a top cover, a midcover, a base, a moveable rotor drive pin, an on-off indicator having a first end and a second end, the rotor drive pin connected to the second end of the on-off indicator, and a handle; and, a stored energy motor operator mounted to the top cover of the rotary circuit breaker, the stored energy motor operator including:

a flag, a connecting bar attached to the flag, a lever having a first end and a second end, the first end of the lever attached to the connecting bar, a hook portion of the lever between the first end of the lever and the second end of the lever, and, a first pin seatable within the hook portion of the lever, the first pin preventing the lever from movement towards the connecting bar when the first pin is seated within the hook portion.

11. The circuit breaker assembly of claim 10 wherein the flag has a first end and a second end, the first end bearing indicia relating to an ON condition, the second end bearing indicia relating to an OFF condition.

12. The circuit breaker assembly of claim 11 wherein the circuit breaker further comprises a pair of separable contacts, and the motor operator includes an outer surface having a window, wherein the flag is moveable relative to the window to position either the first end or second end of the flag within the window.

13. The circuit breaker assembly of claim 12 wherein the second end of the flag is positioned within the window only when the handle of the circuit breaker is in an off position and the contacts are separated.

14. The circuit breaker assembly of claim 10 wherein the first end of the on-off indicator is moveable to abut the second end of the lever and push the hook portion off of the first pin.

15. The circuit breaker assembly of claim 14 wherein the second end of the lever includes a cam surface for abutting with the first end of the on-off indicator.

16. The circuit breaker assembly of claim 14 wherein the connecting bar includes a first end and a second end, the first end of the connecting bar attached to the flag, and the second end of the connecting bar having a pivot pin for pivotal movement within the stored energy motor operator.

17. The circuit breaker assembly of claim 16 wherein the first end of the lever is attached to the connecting bar between the first and second ends of the connecting bar, a spring positioned at the first end of the lever.

18. The circuit breaker assembly of claim 11 wherein the indicia on the first end of the flag is "ON" and the indicia on the second end of the flag is "OFF".

19. The circuit breaker assembly of claim 17 wherein the lever is spring biased towards the first pin.

20. The circuit breaker assembly of claim 10 further comprising a spring attached at one end to the connecting bar and at another end within the stored energy motor operator, wherein the connecting bar is spring biased in a opposite direction of the pin.

21. The stored energy motor operator of claim 1 wherein the first end of the lever is directly connected to the connecting bar between the first and second ends of the connecting bar, a spring positioned at the first end of the lever.

22. A method for indicating handle position of a circuit breaker on a stored energy motor operator, the method comprising:

providing a flag within the stored energy motor operator, the flag having a first end bearing indicia relating to an "ON" condition and a second end bearing indicia relating to an "OFF" condition, the flag attached to a connecting bar for movement within the stored energy motor operator, and a lever attached to the connecting bar;

restricting the lever from movement and positioning the first end of the flag within a window of the stored energy motor operator when a pair of separable contacts within the circuit breaker are abutting and when a handle of the circuit breaker is in an ON position;

when the pair of separable contacts within the circuit breaker are separated, releasing the lever for movement within the stored energy motor operator;

preventing movement of the flag by abutting the connecting bar with the handle when the handle of the circuit breaker is in an ON position and positioning the first end of the flag within the window when the pair of separable contacts within the circuit breaker are separated and when the handle of the circuit breaker is in the ON position; and, allowing movement of the connecting bar when the handle of the circuit breaker is in an OFF position and positioning the second end of the flag within the window when the pair of separable contacts within the circuit breaker are separated and when the handle of the circuit breaker is in an OFF position.

23. The method of claim 22 wherein the lever is attached to the connecting bar at a first spring, wherein restricting the lever from movement comprises providing a first pin within the stored energy motor operator to engage with a hook of the lever to prevent spring biased movement of the lever, and providing a second spring connecting the connecting bar to a point within the stored energy motor operator to spring bias the connecting bar in a direction away from the first pin.

24. The method of claim 23 wherein restricting the lever from movement further comprises hooking the lever onto the first pin.

25. A circuit breaker assembly comprising:

a rotary circuit breaker including a top cover, a midcover, a base, a moveable rotor drive pin, an on-off indicator having a first end and a second end, the rotor drive pin connected to the second end of the on-off indicator, and a handle; and, a stored energy motor operator mounted to the top cover of the rotary circuit breaker, the stored energy motor operator including: flag, a connecting bar attached to the flag, a spring attached at one end to the connecting bar and at another end within the stored energy motor operator, a lever having a first end and a second end, the first end of the lever attached to the connecting bar, a hook portion of the lever between the first end of the lever and the second end of the lever, and, a first pin seatable within the hook portion of the lever, the first pin preventing the lever from movement towards the connecting bar when the first pin is seated within the hook portion, a second pin extending from the handle of the circuit breaker, wherein the connecting bar is spring biased in a opposite direction of the first pin and further wherein the connecting bar is restricted from spring biased movement by the second pin when the handle is in an on position.

26. A method for indicating handle position of a circuit breaker on a stored energy motor operator, the method comprising:

providing a flag within the stored energy motor operator, the flag having a first end bearing indicia relating to an "ON" condition and a second end bearing indicia relating to an "OFF" condition;

attaching the flag to a first end of a connecting bar;

attaching a first end of a lever to the connecting bar at a first spring;

providing a first pin within the stored energy motor operator to engage with a hook of the lever to prevent spring biased movement of the lever;

providing a second spring connecting the connecting bar to a point within the stored energy motor operator to spring bias the connecting bar in a direction away from the first pin;

positioning the first end of the flag within a window of the stored energy motor operator when a pair of separable contacts within the circuit breaker are abutting and when a handle of the circuit breaker is in an ON position;

positioning the first end of the flag within the window when the pair of separable contacts within the circuit breaker are separated and when the handle of the circuit breaker is in an ON position by releasing the hook of the lever from the first pin and preventing the lever and connecting bar from spring biased movement by abutting the connecting bar against a second pin extending from the handle; and, positioning the second end of the flag within the window when the pair of separable contacts within the circuit breaker are separated and when the handle of the circuit breaker is in an OFF position.

* * * * *